US005588560A

United States Patent [19]

Benedict et al.

[11] Patent Number: 5,588,560

[45] Date of Patent: Dec. 31, 1996

[54] ERGONOMERIC DISPENSER FOR VISCOUS MATERIALS

[75] Inventors: Dale G. Benedict, Marysville; Frank R. Wilgus, Powell, both of Ohio; Henry J. Fulks; William T. Gagliardi, both of Midland, Mich.

[73] Assignee: Dow Corning Corporation, Midland, Mich.

[21] Appl. No.: 584,855

[22] Filed: Jan. 11, 1996

[51] Int. Cl.[6] ..... B65D 35/18

[52] U.S. Cl. ..... 222/106; 401/139; 401/266; 425/87

[58] Field of Search ..... 222/192, 107, 222/568, 106; 425/87, 458; 401/266, 139; 239/598

[56] References Cited

U.S. PATENT DOCUMENTS

| | | | |
|---|---|---|---|
| 817,890 | 4/1906 | Williams | 401/262 |
| 1,531,245 | 3/1925 | Ozanne . | |
| 2,804,767 | 9/1957 | Schoen . | |
| 2,888,695 | 6/1959 | Anderson et al. | 401/266 |
| 2,930,063 | 3/1960 | Stull . | |
| 2,943,338 | 7/1960 | Lower | 401/261 |
| 2,988,775 | 6/1961 | Painter et al. | 401/266 X |
| 3,090,071 | 5/1963 | Brooy | 401/266 |
| 3,963,357 | 6/1976 | Crisp | 401/191 |
| 4,101,077 | 7/1978 | Gibson | 239/598 |
| 4,570,834 | 2/1986 | Ward | 222/566 |
| 4,872,778 | 10/1989 | Longo | 401/266 |
| 5,017,113 | 5/1991 | Heaton et al. | 425/87 |
| 5,415,488 | 5/1995 | MacGibbon et al. | 401/266 X |

*Primary Examiner*—Gregory L. Huson
*Attorney, Agent, or Firm*—James L. DeCesare

[57] ABSTRACT

A user friendly dispensing device for viscous materials has an applicator nozzle designed to dispense a bead of material from a squeeze-tube into cracks and corners by being dragged along a surface rather than being pushed. The device has a unique ergonomic shape allowing for ease of application and extrusion of viscous materials such as sealants and caulks squeezed out of the tube. The applicator nozzle is made of plastic; while plastic, a plastic laminate, or metal, is used to make the squeeze-tube.

19 Claims, 2 Drawing Sheets

ERGONOMERIC DISPENSER FOR VISCOUS MATERIALS

BACKGROUND OF THE INVENTION

This invention is directed to a dispenser for a viscous material having an ergonomic shape to enhance not only its aesthetics, but its utilitarian function as well.

Ergonomics is an applied science concerned with the characteristics of people that need to be considered in designing and arranging things that they use, in order that people and things will interact more effectively and safely.

An ergonomically-shaped dispensing device according to our invention allows a viscous material to be extruded and dragged into cracks and corners, rather than being pushed. The ergonomic shape of our device, in particular its tapering design, also facilitates easier extrusions of the viscous material squeezed from a tube by lowering friction loses.

These ergonomic benefits are particularly suited to dispensing viscous materials such as sealants in household consumer applications, where it is often difficult for unskilled consumers to lay a consistent bead of sealant between two rows of tile, in a crevice formed by the intersection of two walls, or along edges of a window pane in sealing glass in a window frame.

Typically, existing sealant tubes and cartridges for the consumer market offer nothing in the way of design to facilitate application of their contents, beyond the standard cylinder with an attached conical nozzle. Thus, there exists a need for new and improved forms of package design.

BRIEF SUMMARY OF THE INVENTION

The invention relates to a device for dispensing viscous materials from an elongated collapsible tube which contains the viscous material. The tube is closed at one end, and open at its other end for discharging the contents of the tube. An applicator nozzle is formed generally in the shape of an elongated, hollow, tubular-like member. The applicator nozzle has an inlet end with an opening. The applicator nozzle is secured to the open end of the tube, and the applicator nozzle includes an outlet end with an opening for extruding a bead from contents squeezed out of the tube.

The applicator nozzle has an arched throat portion which extends upwardly from the inlet end of the applicator nozzle to the outlet end of the applicator nozzle. The arched throat portion is preferably constructed so that there is a gradual transition and change in the cross-sectional shape of the applicator nozzle inlet opening from substantially circular at the inlet end of the applicator nozzle to non-circular at the outlet end of the applicator nozzle, although the shape of the outlet end of the applicator nozzle could also be substantially circular or have the same shape as the inlet end of the applicator nozzle.

A slot is provided in the outlet end of the applicator nozzle. The slot forms an applicator blade extending beyond the outlet end of the applicator nozzle over the opening for extruding the bead. As the tube is squeezed, the bead is extruded on a surface, and the applicator blade smoothes the bead as it is being laid on the surface.

As part of the ergonomic shape, the outlet opening of the applicator nozzle used for extruding the bead is displaced from the longitudinal axis of the tube and the tube opening. This is in contrast to conventional devices in which the opening in the tube and the opening in the applicator nozzle are located along the same axis. In addition, the opening at the outlet end of the applicator nozzle, and the opening at the inlet end of the applicator nozzle, are displaced from one another, and do not lay along the same longitudinal axis as in the case of conventional devices.

These and other features and objects of the invention will become apparent from a consideration of the detailed description.

DETAILED DESCRIPTION

Our invention is directed to a dispensing device in the form of an ergonomically-shaped, flexible, elongated, and collapsible tube, having an applicator nozzle for dispensing various types of viscous materials such as silicone or organic sealants, glazing compounds, or caulking compounds. It is particularly useful with sealants that cure to an elastomer under the action of atmospheric moisture such as silicone sealants, polyurethane sealants, polysulfide sealants, and silane-modified polyether sealants; and sealants that harden by air-drying such as acrylic sealants and butyl rubber sealants.

The device is constructed such that a bead of the viscous material can be easily applied and smoothed in a crevice between two walls, for example, in one easy operation. The device eliminates the old two-step approach where a bead of viscous material is first laid in a crevice, followed by a second step of smoothing the applied bead with one's finger or with a tool.

Figure 1:
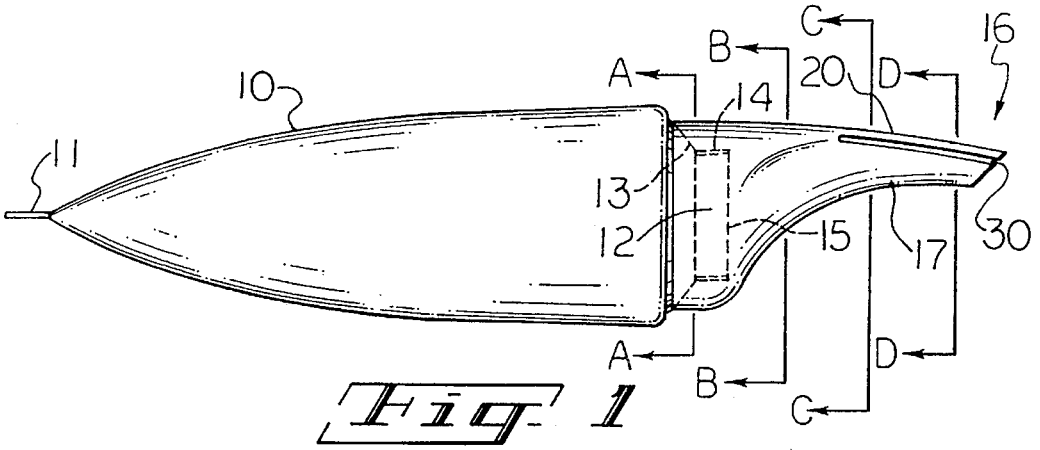
FIG. 1 is a pictorial representation of a dispensing device according to our invention.
Figure 1A:
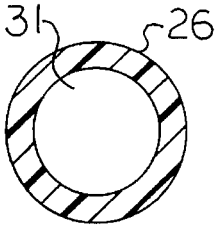
FIGS. 1A, 1B, 1C, and 1D, are cross-sectional views of the applicator nozzle of the dispensing device shown in FIG. 1, taken along the section lines A—A, B—B, C—C, and D—D, respectively.
Figure 1B:
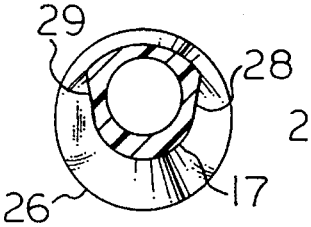
Figure 2:
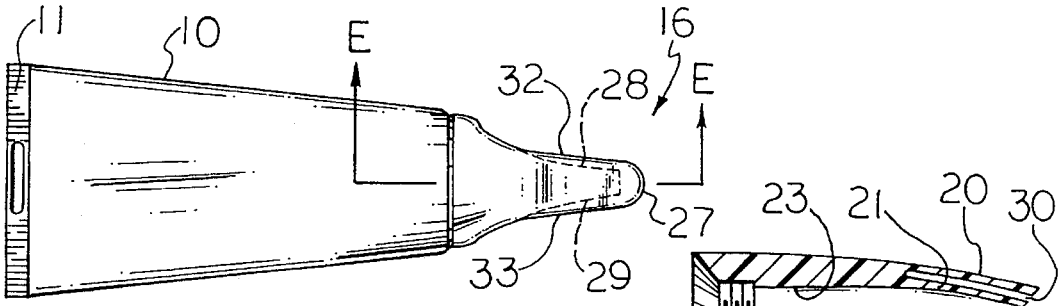
FIG. 2 is a top plan view of the dispensing device shown in FIG. 1.

Thus, in FIG. 1 there can be seen an elongated collapsible tube 10 made of a flexible plastic material such as low density polyethylene, low density polypropylene, polystyrene, polyvinyl chloride, or plastic laminates of low density polyethylene or low density polypropylene with metal foils such as aluminum foil, tin foil, or stainless steel foil. The tube 10 can also be made from a soft metal such as aluminum, but plastic is most preferred. The tube 10 is filled with viscous material, and then one end 11 of the tube 10 is crimped to seal and retain the viscous material within the tube. Crimped end 11 can have a rectangular shape as shown in FIG. 2, or the crimped end 11 can have a rounded configuration.

As a matter of convenience, the crimped end 11 can be provided with a slot (not shown) to enable hanging of the tube 10 for display purposes in hardware stores, for example. Alternatively, tube 10 can be provided with a stand-up type endcap (not shown), to enable it to be displayed in an upright position on a store shelf rather than in a hanging position.

The opposite end of the tube 10 is closed with an end cap 12 having a neck 14 extending from a tapered conical shoulder 13, all parts of which are formed as an integral part of tube 10. The neck portion 14 of cap 12 can be provided with threads in order to provide screw-threaded engagement with corresponding screw threads formed in applicator nozzle 16, or the cap 12 can be designed without screw threads for close-fitting engagement with applicator nozzle 16. End 15 of cap 12 can be left open, or it can be closed using a removable sealing foil.

Applicator nozzle 16 is formed generally in the shape of an elongated, hollow, tubular-like member, having an inlet end and an outlet end. The inlet end is preferably designed to be fitted over and secured to the discharge end of tube 10, although it could be designed to be fitted within and secured to the discharge end of the tube 10. The outlet end of applicator nozzle 16 is designed to extrude a bead from the contents squeezed out of tube 10. The applicator nozzle 16 is made of a plastic material such as a rigid polyethylene, rigid polypropylene, polystyrene, or polyvinyl chloride.

Figure 2E:
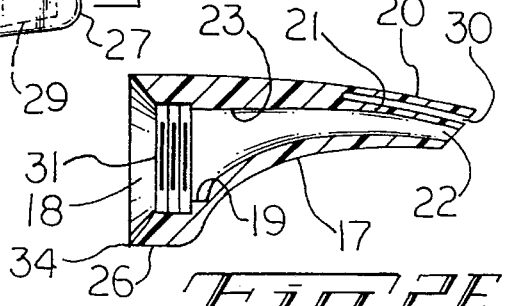
FIG. 2E is another cross-sectional view of the applicator nozzle taken along section line E—E in FIG. 2.
Figure 3:
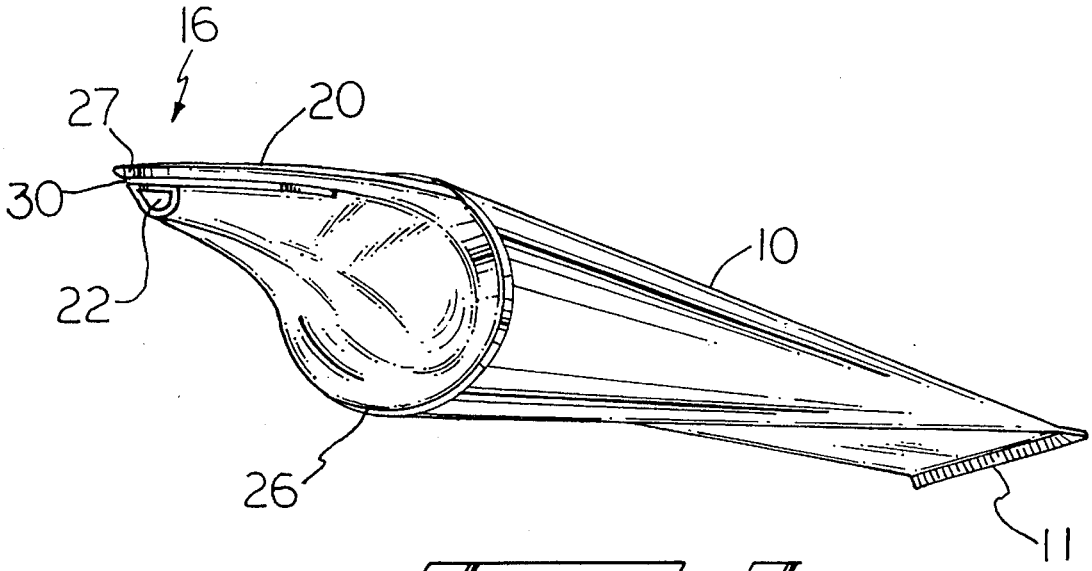
FIG. 3 is an isometric generally front view of our dispensing device showing the collapsible tube and applicator nozzle in order to emphasize the ergonomic shape.
Figure 4:
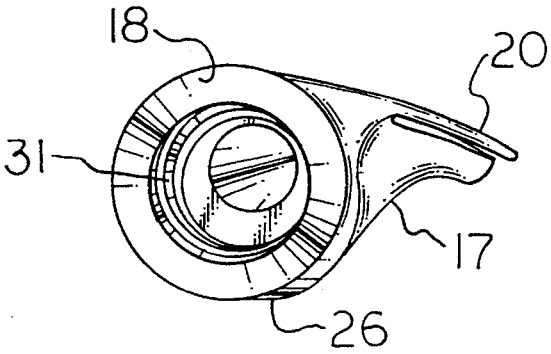
FIG. 4 is an isometric rear view showing the applicator nozzle for further emphasis of its ergonomic shape.

The applicator nozzle 16 as shown in FIG. 2E includes at one end an annularly-shaped rear wall 34. The rear wall 34 has a circumferential surface portion 26, from which extends an arched throat portion 17. One end of arched throat portion 17 extends from the lower portion of circumferential surface 26 upwardly and away from the open end 31 of applicator nozzle 16. At the same time, arched throat portion 17 tapers inwardly with respect to the longitudinal axis of the tube 10. The arched throat portion 17 then terminates at its other end in outlet 22 which provides an exit for extruding a bead of the contents of tube 10.

As previously noted, and as can be seen in FIG. 1, the outlet opening 22 of the applicator nozzle 16 is displaced above the longitudinal axis of the tube 10 and the tube opening 15. Similarly, and as can be seen in FIG. 2E, the opening 22 at the outlet end of the applicator nozzle 16, and the opening 31 at the inlet end of the applicator nozzle 16, are displaced from one another, and do not lay along the same longitudinal axis. Thus, as shown in FIG. 2E, the opening 22 is spaced above the centerline of opening 31.

The annular rear wall 34 and its circumferential surface 26 include an annular beveled groove 18 formed adjacent the open end 31. The annular beveled groove 18, together with an adjacent annular ridge 19, are used to accommodate a close-fitting friction or screw-threaded engagement between the applicator nozzle 16 and cap 12 on collapsible tube 10, which is necessary to maintain these parts together in a single unitary construction.

FIGS. 1A–1D show the gradual transition and preferred changing cross-sectional shape of applicator nozzle opening 31, from a point adjacent the circumferential surface 26 where the opening 31 is substantially circular in cross-section, to a point adjacent applicator nozzle outlet 22 where the cross-sectional shape of the opening 31 becomes substantially half-oval 25. Shapes other than half-oval 25 can also be used if desired, i.e. half-circular or circular.

The interior of applicator nozzle 16 has an arched surface 23 which extends towards the outlet 22. In addition to the arched throat portion 17, the body proper of applicator nozzle 16 is defined by a pair of concave side walls 28 and 29 which taper toward outlet 22 and at the same time merge with the arched throat portion 17.

Figure 1C:
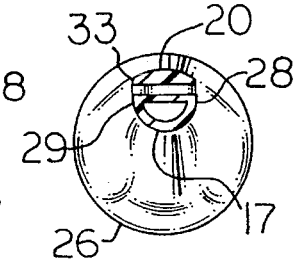
Figure 1D:
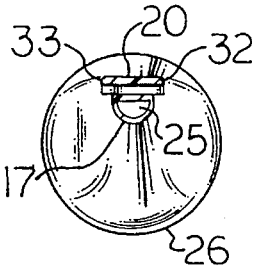

A slot 30 is formed integrally in applicator nozzle 16. The slot 30 provides a short upper wall portion 21 separated from a spatula-shaped applicator blade 20. Applicator blade 20 has a generally convex or arched profile terminating in a rounded tip portion 27, as well as a pair of tapering generally concave-shaped side walls 32 and 33. Applicator blade 20 is substantially arcuate in cross-section as can be seen in FIG. 1C.

The tip 27 of the spatula applicator and the applicator nozzle portion forming outlet 22 should have their surfaces cut at the same angle as depicted in FIGS. 1 and 2E. This can be accomplished with a razor blade if the applicator nozzle is molded of a soft plastic without pre-forming an outlet 22. However, if the applicator nozzle 16 is molded of a hard plastic, it should be pre-formed with outlet 22 and the cut surfaces, and a removable cap or plug (not shown) may be required to seal its contents.

For example, a hinged cap or plug can be formed on arched throat 17, so that when the tube is not in use, the hinged cap or plug can be swung up and inserted over or into outlet 22. When the tube is being used, however, the cap or plug is simply removed and left loosely dangling from its hinge.

While our dispensing device is designed primarily for use in dispensing viscous materials such as silicone or organic sealants, glazing compounds, or caulking compounds, it can be used in any application where it is desired to dispense a viscous material in the form of a small bead. Thus, our device could be used for dispensing greases, gels, ointments, salves, adhesives, pastes, glues, petroleum jellies, or toothpastes, for example.

The dispensing device is intended to be used primarily in applications where it is pulled along a surface rather than being pushed. Thus, in using our device, the foil layer used as a temporary covering over cap 12 is peeled off and removed to expose and provide a way of escape for the viscous contents of tube 10. The cap or plug, if present, is removed from outlet 22. Tube 10 is squeezed, and simultaneously the device is pulled along the surface while depositing a bead of the viscous material.

The spatula-shaped applicator blade 20 is flexible, and therefore it trails along and rides over the deposited viscous bead, smoothing the bead into place as it passes over. Should excesses of viscous material be deposited on the surface, they can accumulate in slot 30, which functions as a reservoir. The spatula tip 27 can then be lifted to remove any excess of the material.

Because the dispensing device of our invention is ergonomically shaped, i.e. human engineered, its aesthetics and overall appearance are more conducive to human use. In addition, due to its unique design and shape, it provides a more comfortable fit for hand application by consumers. Furthermore, in comparison to humdrum state of the art sealant dispensing cylinders, it presents a more attractive packaging alternative.

Other variations may be made in devices and articles of manufacture described herein without departing from the essential features of our invention. The forms of invention are exemplary and not limitations on its scope as defined in the claims.

We claim:

1. A device for dispensing a viscous material comprising an elongated collapsible tube for containing viscous material, the tube being closed at one end and open at its other end for discharging the contents of the tube; an applicator nozzle formed generally in the shape of an elongated, hollow, tubular-like member, the applicator nozzle having an inlet end with an opening, the inlet end of the applicator nozzle being secured to the open end of the tube, the applicator nozzle having an outlet end with an opening adapted to extrude a bead from contents squeezed out of the tube, the applicator nozzle including an arched throat portion extending upwardly from the inlet end of the applicator nozzle to the outlet end of the applicator nozzle, the arched throat portion being so constructed and arranged so as to provide a gradual transition and change in the cross-sectional shape of the applicator nozzle inlet opening from the inlet end of the applicator nozzle to the outlet end of the applicator nozzle; and a slot formed integrally in the outlet end of the applicator nozzle, the slot providing an applicator blade which extends beyond the outlet end of the applicator nozzle over the opening for extruding the bead; whereby as the tube is squeezed and the bead is extruded on a surface, the applicator blade smoothes the bead as it is being laid along the surface.

2. A device for dispensing a viscous material according to claim 1 in which the cross-sectional shape of the applicator nozzle inlet opening is substantially circular, and the cross-sectional shape of the applicator nozzle outlet opening is half-circular or half-oval.

3. A device for dispensing a viscous material according to claim 1 in which the applicator nozzle further includes a pair of opposed and generally concave side walls tapering in a direction toward the applicator nozzle outlet opening, the walls merging with the upwardly extending arched throat portion to form the body of the applicator nozzle.

4. A device for dispensing a viscous material according to claim 1 in which the applicator blade is substantially spatula-shaped, the applicator blade being formed by a pair of tapering generally concave-shaped side walls, the applicator blade having a generally convex or arched profile of substantially arcuate cross-section terminating in a rounded tip portion.

5. A device for dispensing a viscous material according to claim 4 in which the tip portion of the spatula-shaped applicator blade, and the portion of the applicator nozzle forming the applicator nozzle outlet opening, each have their surfaces cut at the same sloping angles.

6. A device for dispensing a viscous material according to claim 5 in which the spatula-shaped applicator blade is flexible, enabling it to trail behind and ride over the deposited bead of viscous material, smoothing the bead into place on the surface as it passes over the deposited bead, and allowing any excess of the viscous material deposited on the surface to accumulate in the slot.

7. A device for dispensing a viscous material according to claim 1 in which the closed end of the tube is crimped in order to seal and retain the viscous material within the tube, the crimped end of the tube being provided with a slot, enabling the dispensing device to be hung from its end for display or storage.

8. A device for dispensing a viscous material according to claim 1 in which the viscous material in the tube is selected from the group consisting of silicone sealants, organic sealants, glazing compounds, caulking compounds, greases, gels, ointments, salves, adhesives, pastes, glues, petroleum jellies, and toothpastes.

9. A device for dispensing a viscous material according to claim 1 in which the viscous material in the tube is a sealant selected from the group consisting of silicone sealants, polyurethane sealants, polysulfide sealants, silane-modified polyether sealants, acrylic sealants, and butyl rubber sealants.

10. A device for dispensing a viscous material according to claim 1 in which the tube is made of a material selected from the group consisting of low density polyethylene, low density polypropylene, polystyrene, polyvinyl chloride, and plastic laminates of low density polyethylene and low density polypropylene with a metal foil; and the applicator nozzle is made of a material selected from the group consisting of rigid polyethylene, rigid polypropylene, polystyrene, and polyvinyl chloride.

11. A device for dispensing a viscous material according to claim 1 in which the outlet opening of the applicator nozzle is displaced above the longitudinal axis of the tube, and the inlet opening of the applicator nozzle and the outlet opening of the applicator nozzle are displaced from one another so that they do not lay along the same longitudinal axis.

12. An applicator nozzle for dispensing a viscous material from an elongated collapsible tube containing viscous material, the applicator nozzle being formed generally in the shape of an elongated, hollow, tubular-like member, the applicator nozzle having an inlet end with an opening, the applicator nozzle being adapted to be secured to the tube, the applicator nozzle having an outlet end with an opening adapted to extrude a bead from contents squeezed out of the tube, the applicator nozzle including an arched throat portion extending upwardly from the inlet end of the applicator nozzle to the outlet end of the applicator nozzle, the arched throat portion being so constructed and arranged so as to provide a gradual transition and change in the cross-sectional shape of the applicator nozzle inlet opening from the inlet end of the applicator nozzle to the outlet end of the applicator nozzle; and a slot formed integrally in the outlet end of the applicator nozzle, the slot providing an applicator blade which extends beyond the outlet end of the applicator nozzle over the opening for extruding the bead; whereby as the tube is squeezed and the bead extruded on a surface, the applicator blade smoothes the bead as it is being laid along the surface.

13. An applicator nozzle according to claim 12 in which the cross-sectional shape of the applicator nozzle inlet opening is substantially circular, and the cross-sectional shape of the applicator nozzle outlet opening is half-circular or half-oval.

14. An applicator nozzle according to claim 12 in which the applicator nozzle further includes a pair of opposed and generally concave side walls tapering in a direction toward the applicator nozzle outlet opening, the walls merging with the upwardly extending arched throat portion to form the body of the applicator nozzle.

15. An applicator nozzle according to claim 12 in which the applicator blade is substantially spatula-shaped, the applicator blade being formed by a pair of tapering generally concave-shaped side walls, the applicator blade having a generally convex or arched profile of substantially arcuate cross-section terminating in a rounded tip portion.

16. An applicator nozzle according to claim 15 in which the tip portion of the spatula-shaped applicator blade, and the portion of the applicator nozzle forming the applicator nozzle outlet opening, have their surfaces cut at the same sloping angles.

17. An applicator nozzle according to claim 16 in which the spatula-shaped applicator blade is flexible, enabling it to trail behind and ride over the deposited bead of viscous material, smoothing the bead into place on the surface as it passes over the deposited bead, and allowing any excess of the viscous material deposited on the surface to accumulate in the slot.

18. An applicator nozzle according to claim 12 in which the applicator nozzle is made of a material selected from the group consisting of rigid polyethylene, rigid polypropylene, polystyrene, and polyvinyl chloride.

19. An applicator nozzle according to claim 12 in which the inlet opening of the applicator nozzle and the outlet opening of the applicator nozzle are displaced from one another so that they do not lay along the same longitudinal axis.

* * * * *